US010315325B2

(12) United States Patent
Votolato et al.

(10) Patent No.: US 10,315,325 B2
(45) Date of Patent: Jun. 11, 2019

(54) BLADE CARTRIDGES AND LOCKABLE SAFETY COVERS

(71) Applicant: Spellbound Development Group, Inc., Newport Beach, CA (US)

(72) Inventors: Earl J. Votolato, Newport Beach, CA (US); David Andrew Sharbaugh, Irvine, CA (US); Frank Matthew Howa, Mission Viejo, CA (US); Ryan Burkes, Huntington Beach, CA (US)

(73) Assignee: Spellbound Development Group, Inc., Newport Beach, CA (US)

( * ) Notice: Subject to any disclaimer, the term of this patent is extended or adjusted under 35 U.S.C. 154(b) by 122 days.

(21) Appl. No.: 15/144,285

(22) Filed: May 2, 2016

(65) Prior Publication Data

US 2017/0120469 A1 May 4, 2017

Related U.S. Application Data

(63) Continuation-in-part of application No. 14/931,093, filed on Nov. 3, 2015.

(51) Int. Cl.
*B26B 29/02* (2006.01)
*B26B 5/00* (2006.01)

(52) U.S. Cl.
CPC ..... *B26B 29/025* (2013.01); *B26B 5/00* (2013.01)

(58) Field of Classification Search
CPC ..... B26B 29/025; B26B 5/00
See application file for complete search history.

(56) References Cited

U.S. PATENT DOCUMENTS

| | | | | |
|---|---|---|---|---|
| 1,426,184 | A | 8/1922 | Hammar | |
| 4,531,286 | A | 7/1985 | Vito et al. | |
| 4,980,977 | A | 1/1991 | Matin et al. | |
| 5,487,346 | A | 1/1996 | Taylor | |
| 5,522,135 | A * | 6/1996 | Votolato | B26B 5/00 30/2 |
| 5,676,677 | A | 10/1997 | Landis | |
| 5,765,289 | A | 6/1998 | Schulz et al. | |
| 5,852,874 | A | 12/1998 | Walker | |
| 6,029,355 | A | 2/2000 | Carlin | |
| 6,032,371 | A | 3/2000 | Chou | |
| 6,282,794 | B1 | 9/2001 | Cho et al. | |
| 6,493,945 | B1 | 12/2002 | DeRosa et al. | |

(Continued)

FOREIGN PATENT DOCUMENTS

| | | |
|---|---|---|
| CA | 2499895 C | 5/2010 |
| CA | 2746710 A1 | 7/2010 |

(Continued)

OTHER PUBLICATIONS

Notice of Ex Porte Reexamination, U.S. Pat. No. 6,718,840, filed Oct. 7, 2010.

*Primary Examiner* — Omar Flores Sanchez
(74) *Attorney, Agent, or Firm* — Fish IP Law, LLP

(57) ABSTRACT

Apparatuses, systems, and methods in which a utility knife includes a hook-type cutter, and at least one of a blade tip cap and a blade cover that is movable relative to a blade or blade cartridge. Contemplated blade tip caps can be fixedly, removably or movably attached to the blade or other portion of a utility knife cartridge. Contemplated blade covers can move from a blade covering configuration to a blade exposing configuration.

4 Claims, 8 Drawing Sheets

(56) References Cited

U.S. PATENT DOCUMENTS

| | | | | |
|---|---|---|---|---|
| 6,857,192 | B1 | 2/2005 | Summers et al. | |
| D521,844 | S | 5/2006 | Kempker et al. | |
| D527,604 | S | 9/2006 | Kempker et al. | |
| D571,180 | S | 6/2008 | Marshall | |
| D575,613 | S | 8/2008 | Jennings | |
| 7,475,480 | B2 | 1/2009 | Votolato | |
| 7,509,742 | B2 | 3/2009 | Votolato | |
| 7,533,595 | B2 | 5/2009 | Domenico | |
| D605,055 | S | 12/2009 | Benson | |
| 7,624,507 | B2 | 12/2009 | Bergstrand | |
| 7,870,675 | B1 | 1/2011 | Della Polla | |
| D636,248 | S | 4/2011 | Still | |
| D469,001 | S | 11/2011 | Still | |
| 8,099,868 | B1 | 1/2012 | Votolato | |
| D660,674 | S | 5/2012 | Still | |
| D660,675 | S | 5/2012 | Gringer et al. | |
| 8,209,870 | B2 | 7/2012 | Votolato et al. | |
| D673,440 | S | 1/2013 | Kempker et al. | |
| 8,347,509 | B2 | 1/2013 | Votolato | |
| D682,065 | S | 5/2013 | Gringer et al. | |
| 8,677,629 | B2 | 3/2014 | Logan | |
| 8,732,956 | B2 | 5/2014 | McGushion et al. | |
| D714,611 | S | 10/2014 | Yu Chen | |
| D714,612 | S | 10/2014 | Gropl et al. | |
| 8,869,408 | B2 | 10/2014 | Votolato | |
| D752,942 | S | 4/2016 | Rohrbach | |
| 9,346,177 | B2 | 5/2016 | Mayes | |
| D767,966 | S | 10/2016 | Standlee | |
| D767,967 | S | 10/2016 | Standlee | |
| 2002/0124412 | A1* | 9/2002 | Votolato | B26B 5/00 30/200 |
| 2004/0154167 | A1* | 8/2004 | Yu Chen | B26B 5/00 30/2 |
| 2005/0217114 | A1 | 10/2005 | Votolato | |
| 2006/0048389 | A1 | 3/2006 | Votolato | |
| 2007/0272061 | A1 | 11/2007 | Hsieh | |
| 2009/0151168 | A1 | 6/2009 | Dadam | |
| 2010/0263217 | A1 | 10/2010 | Baxter et al. | |
| 2010/0263219 | A1 | 10/2010 | Kempker et al. | |
| 2010/0293796 | A1 | 11/2010 | Votolato | |
| 2011/0167646 | A1 | 7/2011 | Schmidt | |
| 2013/0298409 | A1 | 11/2013 | Jacobs et al. | |
| 2014/0345146 | A1 | 11/2014 | Schekalla | |
| 2015/0298330 | A1 | 10/2015 | Yu Chen | |
| 2015/0336283 | A1 | 11/2015 | Davis | |
| 2017/0120469 | A1* | 5/2017 | Votolato | B26B 5/00 |

FOREIGN PATENT DOCUMENTS

| | | | |
|---|---|---|---|
| WO | 2010/078007 | A1 | 7/2010 |
| WO | 2010/078007 | A3 | 7/2010 |

* cited by examiner

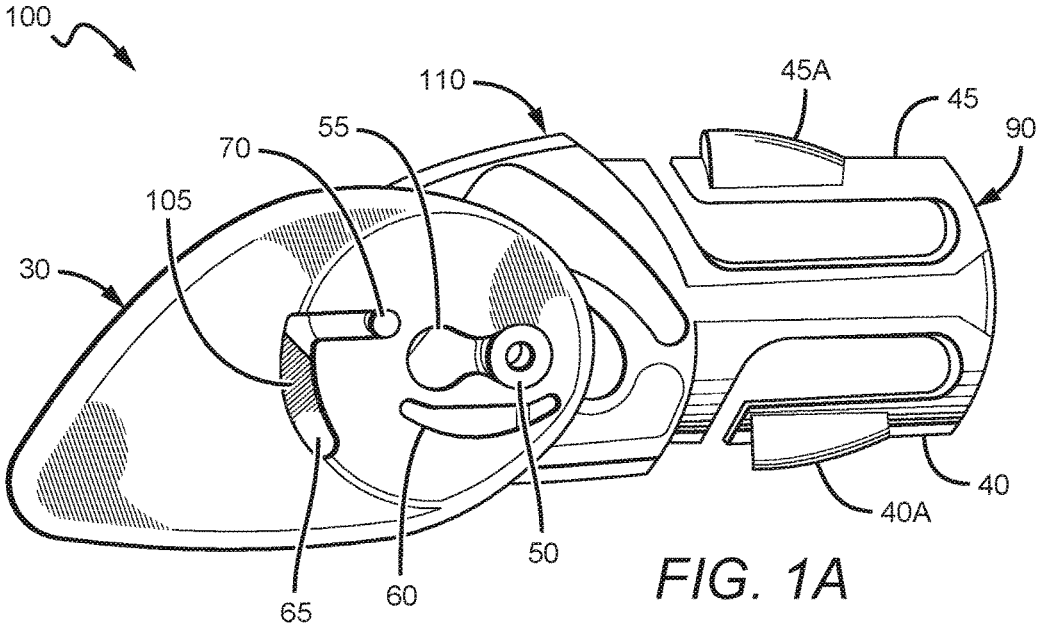
FIG. 1A
FIG. 1B
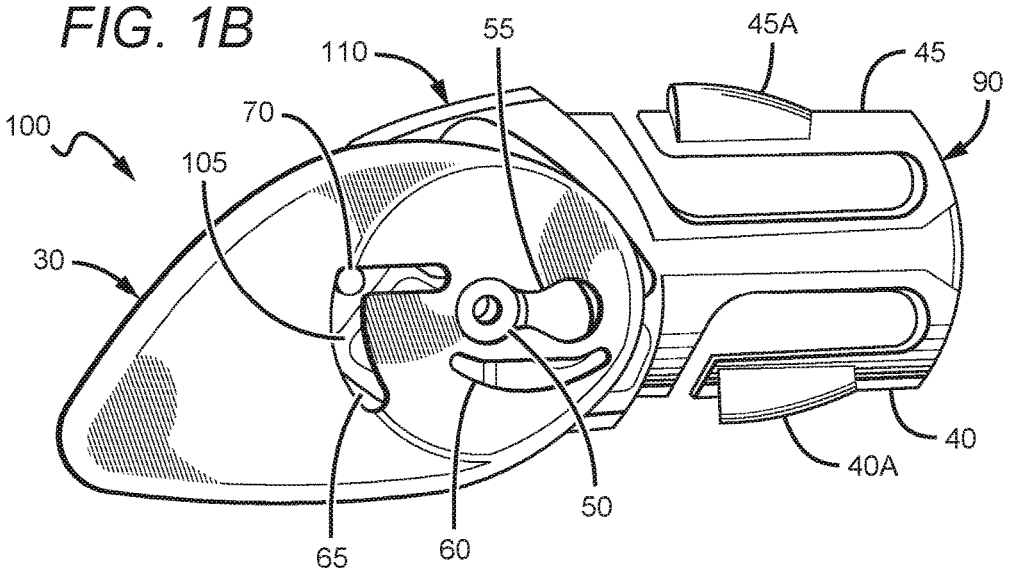

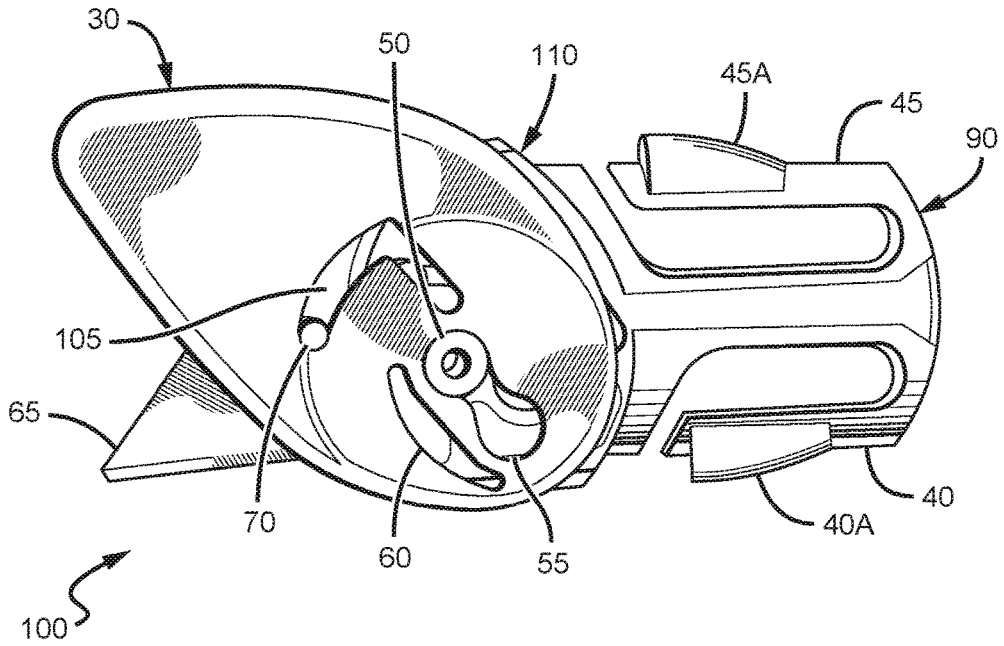
FIG. 1C
FIG. 2A
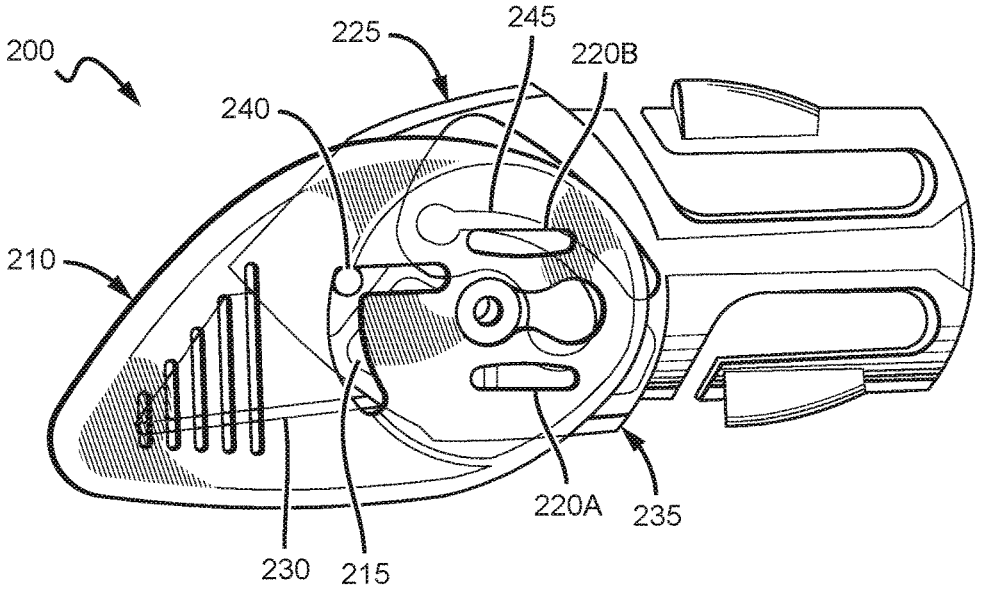

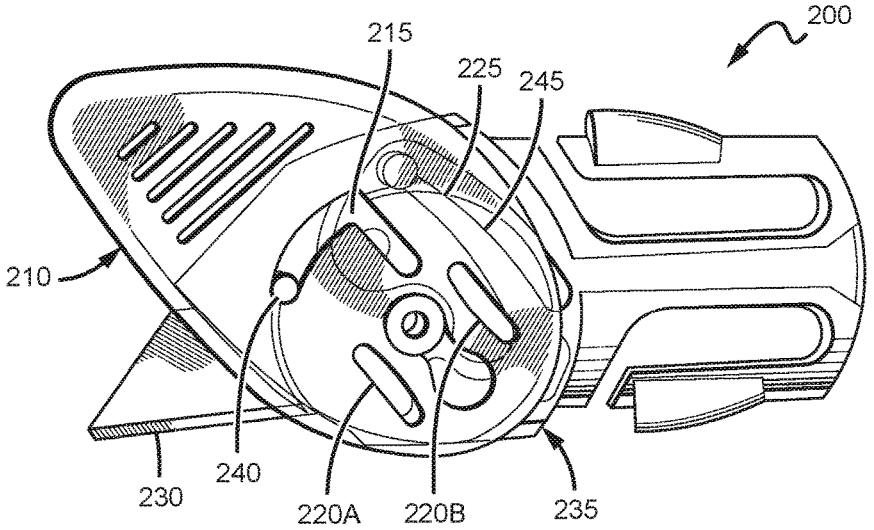
FIG. 2B
FIG. 3
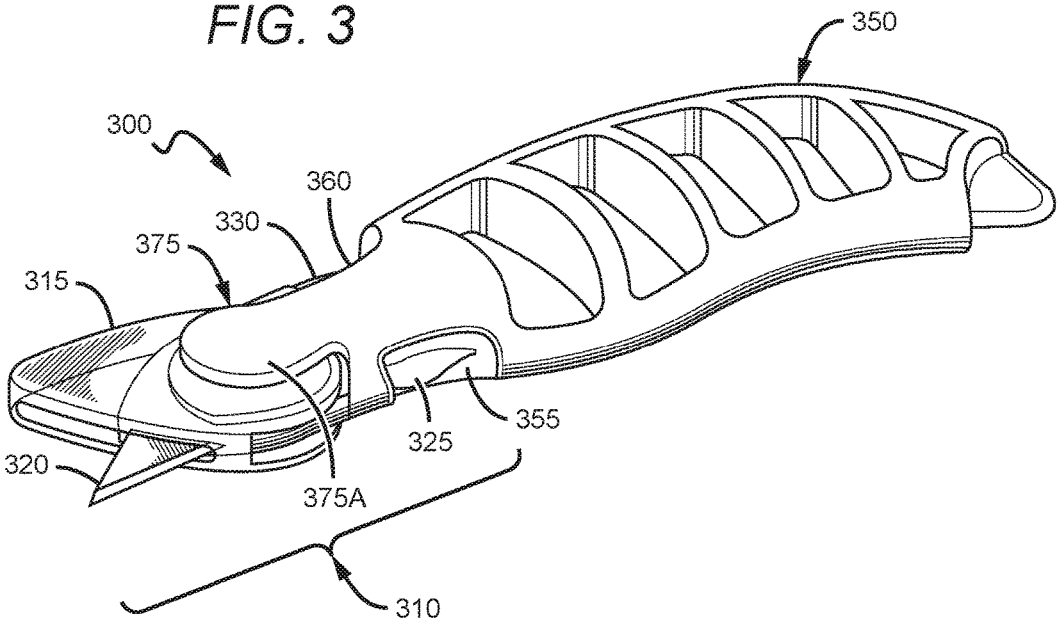

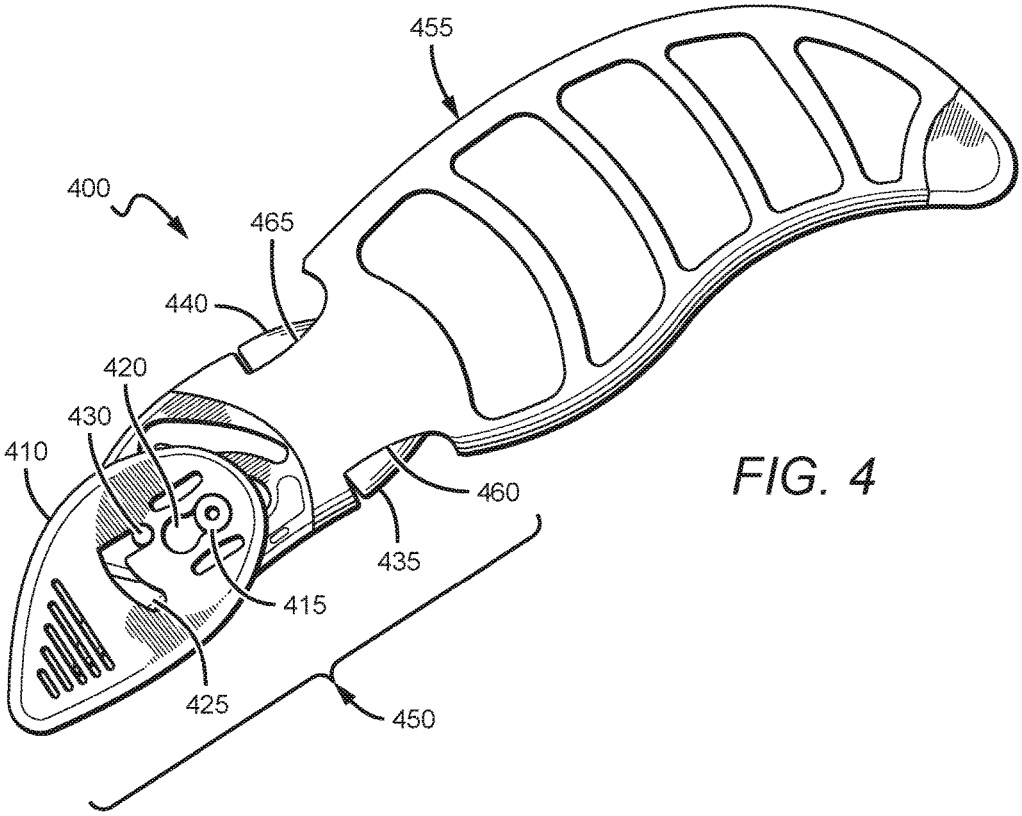
FIG. 4
FIG. 5A
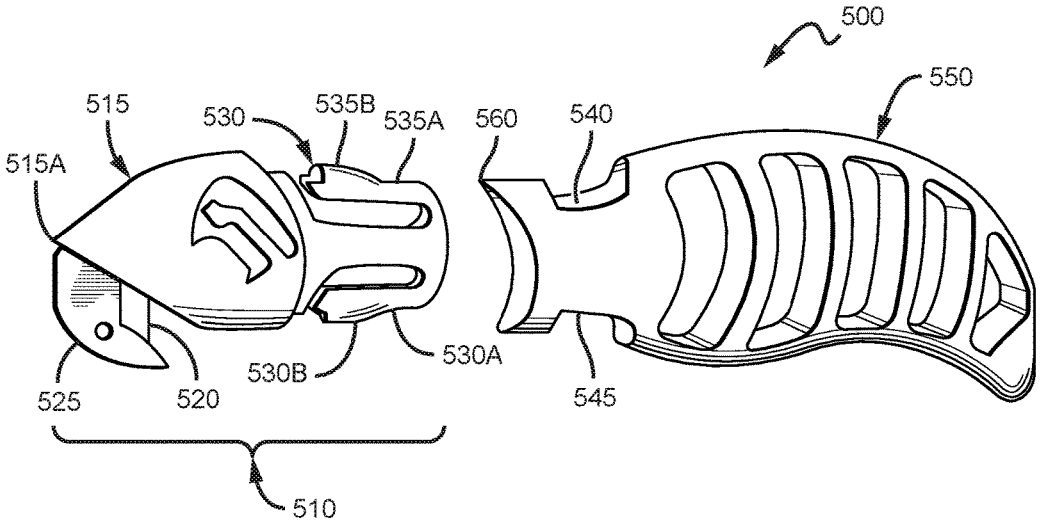

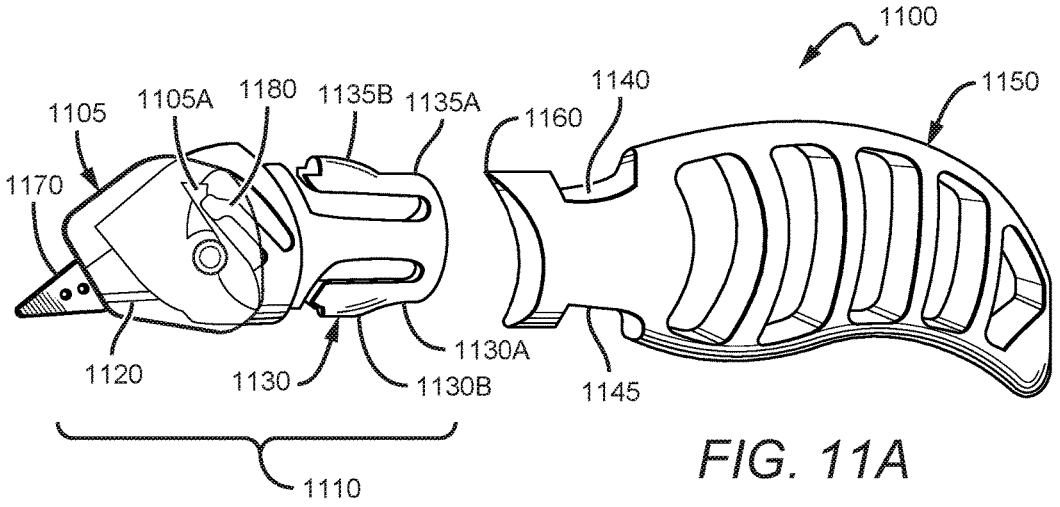
FIG. 11A
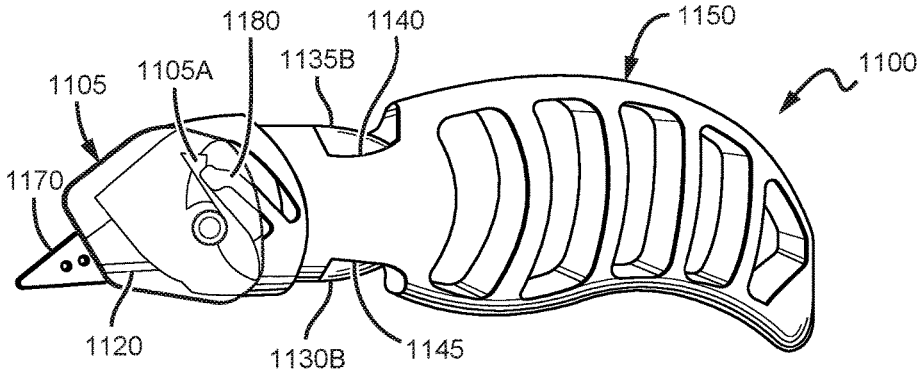
FIG. 11B
FIG. 11C
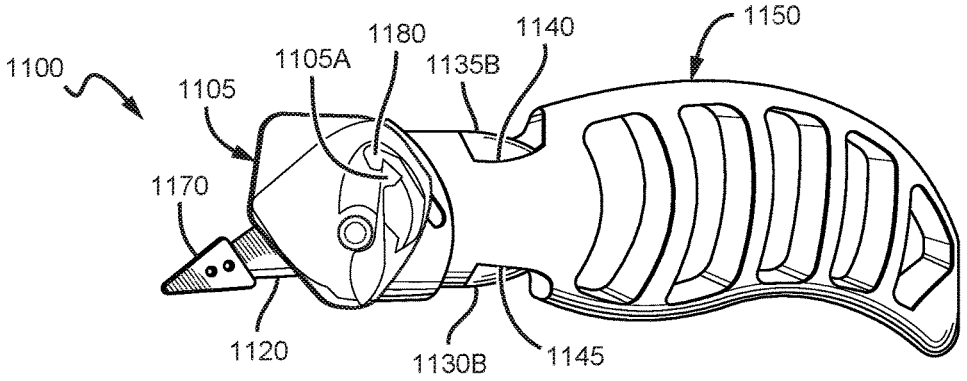

BLADE CARTRIDGES AND LOCKABLE SAFETY COVERS

The application is a continuation-in-part of U.S. patent application Ser. No. 14/931,093, filed on Nov. 3, 2015. This and all other publications referenced herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

FIELD OF THE INVENTION

The field of the invention is utility knives.

BACKGROUND

The background description includes information that may be useful in understanding the present invention. It is not an admission that any of the information provided herein is prior art or relevant to the presently claimed invention, or that any publication specifically or implicitly referenced is prior art.

Safety has been an important concern when using utility knives as many users inadvertently cut themselves with the exposed blades. Some efforts have been made to address this safety concern.

For example, U.S. Pat. No. 8,347,509 teaches a blade cartridge with a blade cover that defaults to a closed position in which the blade cover surrounds the otherwise exposed portion of a blade. A spring is used to push the blade cover into the closed position, and the blade cover remains in the closed position until pressure is applied to push the cover to an open configuration where the blade is exposed for use.

This and all other publications referenced herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Unfortunately, the '509 Patent's blade cartridge and blade cover fails to address several other safety issues, for example, injuries that can occur from an inadvertent detaching of the cartridge or blade from a tool handle.

U.S. Pat. Nos. 7,475,480 and 8,099,868 each strive to solve this problem by featuring a flexing latch to secure the handle to the cartridge. While the cartridge is inserted into the handle, the latches flex into a strained position in order to fit into the receiving channel of the handle. Once the cartridge has been fully inserted into the handle, the latches then return to a relaxed, unstrained position by pushing through openings on either side of the handle. Such a latching mechanism is useful in securing the blade.

Unfortunately, the cartridge is at risk of inadvertent detachment from the handle because the latches are positioned on the handle at a place where users commonly squeeze their thumb and first finger together to grip and manipulate the tool.

Thus, there is still a need for improved and safer utility knives and utility knife components.

SUMMARY OF THE INVENTION

The following description includes information that may be useful in understanding the present invention. It is not an admission that any of the information provided herein is prior art or relevant to the presently claimed invention, or that any publication specifically or implicitly referenced is prior art.

The inventive subject matter provides apparatus, systems, and methods in which a utility knife includes a blade cover that is movable from a locked position to an unlocked position relative to at least one of a blade cartridge, a blade holder, and a tool handle. When the blade cover is in an unlocked position, the blade cover can advantageously be moved (e.g., rotate (partially or fully), pivot, slide, swivel, turn, bend, flex) from a blade covering configuration to a blade exposing configuration.

The blade cover could be biased towards the blade covering configuration, for example, via a spring, such that a force (e.g., from a cutting surface or a user) is required to move to the blade exposing configuration.

In some aspects, contemplated utility knives could comprise a cartridge that is coupled to or includes a blade, and a blade cover coupled to the cartridge. The cartridge could comprise a stem that extends from an end of the cartridge opposite the blade. The stem could include one or more flexible spring arms that each includes a locking member sized and dimensioned to be releasably received by a catch of a tool handle. Advantageously, the spring arms could be configured to flex in opposite directions and towards one another such that the cartridge could readily be removed from the tool handle when desired. Additionally or alternatively, the catches that receive the locking mechanisms could be positioned on top and bottom portions of the tool handle (when the tool is being used), such that unintentional release of the cartridge from the handle during use can be avoided.

In some aspects of the inventive subject matter, utility knives having hook-type cutters are provided. Knives having hook-type cutters can advantageously protect users from inadvertent cuts, since the blade's edge is recessed relative to other portions of the cutter. Viewed from another perspective, the blade's cutting edge is covered on both ends by material that extends out further than the blade's cutting edge. In this manner, the end materials act as a barrier or block to the blade edge for objects that are larger than the narrow space (e.g., less than 20 mm, less than 15 mm, less than 10 mm, less than 5 mm) between the end materials.

Such hook-type cutters have been found to be especially useful in cutting shrink wrap, bubble wrap, straps, bands, cardboard, and other items that are thin and can readily fit within the narrow space between the end portions. Additionally, one or more end portions could include a piercer such that an object can be pierced and cut open with a single swipe or other movement.

Contemplated utility knives could include a cartridge including a movable member, a blade holder portion, a blade, and a hook-type cutter. A blade cover could be movably coupled to the cartridge, and include an opening member that cooperates with the cartridge's movable member to adjust the blade cover between blade covering and blade exposing configurations. For example, the opening member could modify a position or a shape of the movable member relative to the rest of the cartridge.

In some other aspects, a utility knife comprises a cartridge coupled to a blade and including a first blade holder that partially encloses a first side of the blade. A second blade holder (e.g., a blade tip cap) can partially enclose a second side of the blade opposite the first side. The blade can advantageously be recessed relative to the first and second blade holders, thereby forming a hook-type cutter.

The second blade holder could be permanently coupled to the blade (fixedly or movably—e.g., rotatably, pivotably), or could be removably coupled to the blade. For example, the first and second blade holders could be coupled to one another via a flexible connector. When the user wishes to access the portion of the blade covered by the second blade holder, the user could pull the second blade holder away from the blade. The second blade holder being connected to the first blade holder (cartridge) via the connector reduces the risk that the blade tip cover will be lost.

Having a hook-type cutter as described above could help prevent accidents from occurring. For additional safety, a movable cover could be coupled to the cartridge, and be adjustable between two or more positions or configurations.

In still further aspects, a utility knife could comprise a blade at least partially embedded in a blade holder. The blade could comprise first and second ends, and a cutting edge extending there-between. The knife could additionally include a blade cap that is sized and dimensioned to receive a portion of the blade not covered by the blade holder. The blade cap could advantageously be coupled to at least one of the blade and the blade holder in a manner that allows the blade cap to move between first and second positions, wherein the blade cap covers more of the blade's cutting edge when in the first position relative to the second position.

The blade cap could be a separate piece of material that is removable from the blade and blade holder. Additionally or alternatively, the blade cap could be a separate piece of material that is connected to the blade holder (or other portion of a knife cartridge) via a connector. Additionally or alternatively, the blade cap could be attached to the blade holder, blade, or other portion of the cartridge in a manner that allows the blade cap to pivot or rotate relative to the blade edge. In these and other embodiments, the blade cap could be biased to a position that covers more of the blade's edge that when pivoted or rotated using force.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWING

FIG. 1A illustrates a blade cartridge and cover of the inventive subject matter, wherein the cover is in a locked position.

FIG. 1B illustrates the blade cartridge and cover of FIG. 1A, wherein the cover is in an unlocked position.

FIG. 1C illustrates the blade cartridge and cover of FIGS. 1A-1B, wherein the cover is in a blade exposing configuration.

FIG. 2A illustrates another blade cartridge and cover of the inventive subject matter, wherein the cover is in an unlocked position and a blade covering configuration.

FIG. 2B illustrates the blade cartridge and cover of FIG. 2A, wherein the cover is in an unlocked position and a blade exposing configuration.

FIG. 3 illustrates a utility knife of the inventive subject matter.

FIG. 4 illustrates another utility knife of the inventive subject matter.

FIG. 5A illustrates another embodiment of a utility knife, including a blade cartridge and a tool handle.

FIGS. 11A-11C illustrate a utility knife having a blade tip cap and a blade cover.

DETAILED DESCRIPTION OF THE DRAWINGS

Figure 5B:
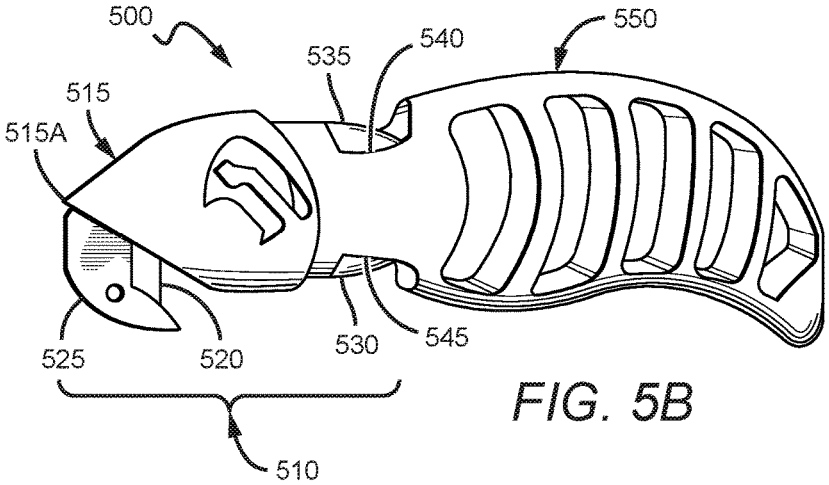
FIG. 5B illustrates the utility knife of FIG. 5A, wherein the blade cartridge is locked into the tool handle.

The inventive subject matter provides utility knives with a safety cover that is movable from a locked position to an unlocked position (and vice versa), and from a biased unexposed blade configuration to an exposed blade configuration (and vice versa). The utility knives can include a cartridge for a blade and blade cover, and a tool handle that is configured to securely and releasably receive the cartridge.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

FIGS. 1A-1C illustrate a utility knife cartridge 100 of the inventive subject matter. Cartridge 100 comprises blade holder or blade holder component 110, blade 65, stem 90, and blade cover 30. Blade holder 110 and stem 90 could be made from a single piece of material (e.g., injected molded plastic, metal). In other contemplated embodiments, blade holder 110 and stem 90 could be made from separate pieces of material.

Where a separate tool handle is not used with a cartridge of the inventive subject matter, stem 90 could be replaced with or otherwise include a handle. Here, cartridge 100 is one of many cartridges that can be used in combination with a tool handle (e.g., 350 of FIG. 3). In order to allow cartridge 100 to be releasably coupled to the tool handle, stem 90 includes a first arm 40 with a first stem locking member 40A, and a second arm 45 with a second locking member 45A. Each locking member is configured to mate with a catch of a tool handle as further described below.

Blade cover 30 is advantageously configured to move (e.g., slide) relative to the blade holder from a locked position, as shown in FIG. 1A, to an unlocked position, as shown in FIG. 1B. Blade holder 110 comprises a lock protrusion 50 that is configured to cooperate with blade cover's lock opening 55. This allows the blade cover 30 to be locked in a safe position that keeps the blade from being inadvertently exposed, regardless of whether or not the cartridge has been inserted into a tool handle.

Additionally, blade cover 30 is configured to move (e.g., rotate) relative to the blade holder and blade from a blade covering configuration, as shown in FIG. 1B, to a blade exposing configuration, as shown in FIG. 1C. Blade holder 110 comprises a movement protrusion 70 that is configured to cooperate with blade cover's angled channel 105 to allow for rotation of blade cover 30 when it is in an unlocked position.

Here, lock opening 55 and angled channel 105 are shown as extending through a thickness of blade cover 30. However, it should be appreciated that lock protrusion 50 and movement protrusion 70 could additionally or alternatively cooperate with recessed portions or grooves on an inner surface of blade cover 30.

Still further, while blade holder 110 is shown to have the lock and movement protrusions, and blade cover 30 is shown to have the lock opening and angled channel, it should be appreciated that one or more of the protrusions could be included on the blade cover, and one or more of the openings or channels could be included on the blade holder.

In the embodiment shown, lock opening 55 is peanut or nephroid shaped, and includes a narrow central portion between two wider ends. Lock protrusion 50 can be positioned, sized and dimensioned to snugly fit through the narrow central portion when a force towards one of the wider ends is applied by a user. Viewed from another perspective, a user could use at least one of a thumb and forefinger to hold the blade cover and move it towards the stem 90 to unlock the blade cover. Additionally or alternatively, the user could move the blade cover towards the blade 65 to lock the blade cover.

One or more slots (e.g., 60) could be included on blade cover 30 to allow the central portion of lock opening 55 to widen and allow lock protrusion 50 to pass through. Additionally or alternatively, one or more slots could be included on blade cover that allows a user to see blade 65 (or other tool) when blade cover is in a blade covering configuration.

In some embodiments, the lock protrusion 50 could have a varying thickness, and include at least one thinner portion and at least one wider portion. The wider portion(s) could be wider than the narrow central portion of lock opening 55, and thus not sized and dimensioned to pass through the narrow central portion. The thinner portion(s) could be positioned further away from blade holder 110 than the wider portion, such that lock protrusion 50 could be pushed in, and the thinner portion could pass through the narrow central portion of lock opening 55. Additionally or alternatively, the thinner portion could be positioned closer to the blade holder such that the lock protrusion could be pulled out, and the thinner portion could pass through the narrow central portion.

When the blade cover is moved from a locked position (as shown in FIG. 1A) to an unlocked position (as shown in FIG. 1B), movement protrusion 70 could be positioned at a corner of channel 105 such that blade cover 30 can move from a blade covering configuration (as shown in FIG. 1B) to a blade exposing configuration (as shown in FIG. 1C). As illustrated in FIGS. 1A-1C, the channel 105 can include a first sub-channel and a second sub-channel. The movement protrusion 70 could move through first sub-channel when blade cover 30 moves between a locked position and an unlocked configuration. The movement protrusion 70 could move through the second curved sub-channel when blade cover 30 moves between a blade covering configuration and a blade exposing configuration.

In some embodiments, blade cover 30 could be biased towards the blade covering configuration (e.g., via a spring). An exemplary spring biasing mechanism is the curved spring carried in a groove and described in U.S. Pat. No. 8,099,868 to Votolato. When blade cover 30 is in an unlocked position, a user could apply a pressure to a portion of the blade cover, for example, via a cutting surface, and cause the blade to be exposed to apply a cut to the cutting surface (item to be cut). When the pressure is released (e.g., when the knife is moved away from a cutting surface), blade cover 30 could automatically move back to a blade covering configuration.

It should be appreciated that the locking feature (lock opening 55 and lock protrusion 50) can allow a user to repeatedly lock and unlock the cover with a simple movement. A user can simply grab the blade cover with a forefinger and thumb, and pull or push the blade cover slightly away from or towards the knife handle. This can prevent accidental exposure to the cartridge blade when the knife is not in use (e.g., when it is in a pocket of a user, is placed in a toolbox or left unattended, when the cartridge is being coupled to, or removed from, a tool holder.

It is contemplated that cartridge 100 could be replaced with another blade cartridge, for example, when blade 65 becomes dull. Additionally or alternatively, cartridge 100 could be replaced with a different tool cartridge (e.g., screw driver cartridge, saw cartridge, scraper cartridge). The different tool cartridges could be the same as utility knife cartridge 100, except that blade 65 is replaced with a different tool.

FIGS. 2A-2B illustrate another utility knife cartridge 200 of the inventive subject matter. Cartridge 200 includes blade holder 235 having a stem, blade 230, and a partially transparent blade cover 210. Cartridge 200 includes a lock opening and lock protrusion similar to those described in FIGS. 1A-1C. Cartridge 200 also includes slots 220A and 220B that provide some flexibility to blade cover 210. Furthermore, cartridge 200 includes a movement protrusion 240 that cooperates with channel 215 to allow blade cover 210 to adjust between locked and unlocked positions, and between blade covering (closed) and blade exposing (open) configurations.

In some embodiments, a cartridge blade cover could default/be biased to a closed position in which the blade cover surrounds the otherwise exposed portion of a blade. A spring (e.g., a curved spring) could be included, which pushes the blade cover into the closed position. The blade cover could remain in the closed position until pressure is applied to push the cover to an open configuration where the blade is exposed for use.

Additionally or alternatively to a spring, cartridge 200 could include a movable member 245 that can bias the blade cover in the closed position. When blade cover 210 is moved to an open configuration by a cutting surface or other force, blade cover 210 can cause movable member 245 to flex or straighten to a strained position within through-hole or recessed portion 225 in which movable member 245 is positioned (as shown in FIG. 2B).

As discussed above, cartridges of the inventive subject matter could include stems that are configured to be releasably received by one or more tool handles of the inventive subject matter. FIG. 3 illustrates a utility knife 300, which includes a cartridge 310 releasably locked into place on tool handle 350, and an anti-tamper guard.

Cartridge 310 includes a blade holder, blade 320, blade cover 315, and a stem that includes two flexible arms that include two locking members (325, 330). In one embodiment, the stem and flexible arms are configured such that considerable pressure is required to depress the two flexible arms. In another embodiment, only slight pressure is required to depress the two flexible arms. Further, in some embodiments, after pressure is released from the two flexible arms, the arms return back to their original positions. In a further embodiment, only when the two flexible arms are depressed is cartridge 310 able to fit into tool handle 350, while in another only one flexible arm must be depressed.

Tool handle 350 includes a first catch 355 sized and dimensioned to receive a first locking member (e.g., 40A, 325), and a second catch 360 sized and dimensioned to receive a second locking member (e.g., 45A, 330). In the embodiment shown, catch 355 is located on a bottom edge of knife 300, and catch 360 is located on a top edge of knife 300. When cartridge 310 is locked with tool handle 350, the two flexible arms can be flexed towards each other (away from their resting positions) to allow locking members 325 and 330 to snap into catches 355 and 360, respectively. From another perspective, the flexible arms of cartridge 310 could be configured such that, in a relaxed position, locking members 325 and 330 rest snugly and securely within catches 355 and 360.

The receiving end of the opening of the tool holder can be sized and dimensioned to receive the arms of cartridge 310 in a way that momentarily depresses those arms, allowing for locking members 325 and 330 to slide into the tool handle opening, and then to snap back to lock into place in catches 355 and 365 located on the vertical plane or spine of the handle.

When removing cartridge 310 for replacement, a user can simply squeeze or pinch the stem arms together via locking members 325 and 330, allowing cartridge 310 to be pulled out from tool handle 350. In some embodiments, the force required to depress the stem arms is great, while in others slight pressure is sufficient.

Cartridge 310 can further be configured such that, while inserting cartridge 310 into tool handle 350, cartridge 310 is shifted into a locked configuration where blade cover 315 cannot move in relation to blade 320. This can be accomplished, for example, by reversing the orientation of angled channel 105 such that a pushing motion along blade cover 315 toward tool handle 350 slides the lock protrusion along the angled channel into a locked conformation.

Cartridge 310 can further be configured such that, while removing cartridge 310 from tool handle 350, cartridge 310 is shifted into a locked configuration where blade cover 315 cannot move in relation to blade 320. This can be accomplished, for example, by using the orientation of angled channel 105 such that a pulling motion along blade cover 315 away from tool handle 350 slides the lock protrusion along the angled channel into a locked conformation.

Whereas known utility knives included spring arms protruding along the horizontal axis and perpendicular to the orientation of the blade, cartridges of the inventive subject matter can advantageously include flexible arms on the vertical plane, and in the same direction as the orientation of the blade. Viewed from another perspective, when knife 300 is used to make a cut, a user can grab left and right sides of the blade without inadvertently releasing the cartridge from the tool handle.

Furthermore, knife 300 additionally includes an anti-tamper guard 375, which protects blade cover 315 from being tampered with or taken off of cartridge 310 when cartridge 310 is coupled with tool handle 350. As illustrated, tool handle 350 could comprise anti-tamper guard 375, which could at least partially surround first and second side surfaces of blade cover 315. More specifically anti-tamper guard 375 can include a first side portion 375A and a second side portion substantially parallel to front side portion 375A. The first and second side portions form a gap sized and dimensioned to receive a thickness of cartridge 310, including a portion of blade cover 315.

The outer surface of one or both of the side portions could include a logo, design or other marking. The inner surface of one or both side portions could include protrusions that are sized and dimensioned to couple with an aperture or recesses of a lock protrusion (e.g., 50 in FIG. 1A). For example, each of the two portions could include a protrusion such that the two protrusions face one another. These two protrusions could couple with a through-hole or recessed portions of a lock protrusion via a snap fit or any other suitable mechanism.

An anti-tamper guard as described above could advantageously protect against unwanted tampering of the blade cover, yet allow the blade cover to move between unlocked, locked positions, and closed and open configurations. Anti-tamper guards are further described and shown in FIGS. 7A-7D.

FIG. 4 illustrates another utility knife 400 of the inventive subject matter. Knife 400 includes handle 455 and cartridge 450. Cartridge 450 includes a blade holder, blade, blade cover 410, and two flexible arms including locking members 435 and 440. Handle 455 includes first and second catches 460 and 465, which are sized and dimensioned to block locking members 435 and 440 in place.

Cartridge 450 is similar to the cartridges shown in FIGS. 1A-1C and FIGS. 2A-2B, and includes mechanisms that allow blade cover 410 to move between locked and unlocked positions, and between closed and open configurations. As illustrated, blade cover 410 is in a locked position. A user could use his thumb and forefinger, a cutting surface, or any other suitable force to move blade cover 410 towards handle 455 such that locking protrusion 415 moves to an opposite end of lock opening 420 (unlocked position). This would position moving protrusion 430 within the corner of angled channel 425, and allow a user to rotate blade cover 410 to a blade exposing (open) configuration. Some contemplated channels allow blade cover 410 to rotate between 25-75 degrees, more preferably between 25-65 degrees, and even more preferably between 25-55 degrees.

FIGS. 5A and 5B illustrate yet another utility knife 500 of the inventive subject matter. FIG. 5A shows cartridge 510 and handle 550 separated from one another, and FIG. 5B shows the components coupled together.

Cartridge 510 includes a blade holder (or blade holder portion) 515, blade 520, blade top shield 525, and a stem 530 that includes two flexible arms 530A, 535A having two locking members 530B, 535B. The stem 530 and flexible arms 530A, 535A are configured such that a pressure is required to depress the two flexible arms 530A, 535A. After a pressure is released from the two flexible arms 530A, 535A, they return back to their original positions. It is contemplated that one or both of the flexible arms 530A, 535A will need to be squeezed towards one another in order to releasably couple with handle 550's catches 540 and 545.

Tool handle 550 includes a first catch 540 sized and dimensioned to receive a first locking member 535B, and a second catch 545 sized and dimensioned to receive a second locking member 530B. In the embodiment shown, catch 545 is located on a bottom edge of knife 500, and catch 540 is located on a top edge of knife 500. When cartridge 510 is locked with tool handle 550 as shown in FIG. 5B, the two flexible arms can be flexed towards each other (away from their resting positions) to allow locking members 535B and 530B to snap into catches 540 and 545, respectively. From another perspective, the flexible arms of cartridge 510 could be configured such that, in a relaxed position, locking members 535B and 530B rest snugly and securely within catches 540 and 545.

The receiving end 560 of the opening of the tool handle can be sized and dimensioned to receive the arms of cartridge 510 in a way that momentarily depresses those arms, allowing for locking members 530B and 535B to slide into the tool handle opening, and then to snap back to lock into place in catches 540 and 545 located on the vertical plane or spine of the handle.

When removing cartridge 510 for replacement, a user can simply squeeze or pinch the stem arms 535A and 530A together via locking members 535B and 530B, allowing cartridge 510 to be pulled out from tool handle 550.

It should be appreciated that a blade cover as described in FIGS. 1-4 (e.g., blade cover 315) could advantageously be used with cartridge 510. Cartridge 510 could include a lock protrusion (e.g., 50 in FIG. 1A), which could be coupled with a blade cover lock opening (e.g., 55 in FIG. 1A). Cartridge 510 could also include a movement protrusion (e.g., 70 in FIG. 1A), which could be coupled with a blade cover channel (e.g., 105) as described above. Viewed from another perspective, cartridge 510 could be identical to cartridges 100, 310 or 200, which include blade covers, except for the positioning of blade 520 and the inclusion of blade top shield 525.

As shown in FIGS. 5A-5B, blade holder 515, blade 520, blade top shield 525 are configured such that a blade cover may not be required. An edge of blade holder 515 and an edge of blade top shield (referred to herein from time to time as blade cap, second blade holder, or blade tip cap) 525 define a recessed area that includes blade 520. Only a small portion of blade 520's edge is exposed (e.g., less than 2 cm, less than 1.5 cm, less than 1 cm), and the exposed edge portion is recessed relative to an end of blade top shield 525, which could comprise a piercer or a blunt tip. Viewed from another perspective, cartridge 510 is configured such that an object will not be cut by blade 520 unless placed within a recess defined by an edge of a blade holder and an edge of a blade top shield. In preferred embodiments, blade top shield 525's end or tip could extend at least 1 mm, at least 2 mm, at least 5 mm, or even at least 10 mm or more further towards the cartridge stem than blade 520's edge. Additionally or alternatively, blade holder 515's tip 515A could extend further away from the cartridge stem than blade top shield (e.g., at least 1 mm, at least 2 mm, at least 5 mm or even more), and could comprise a pointed tip that acts as a piercer.

Figure 6A:
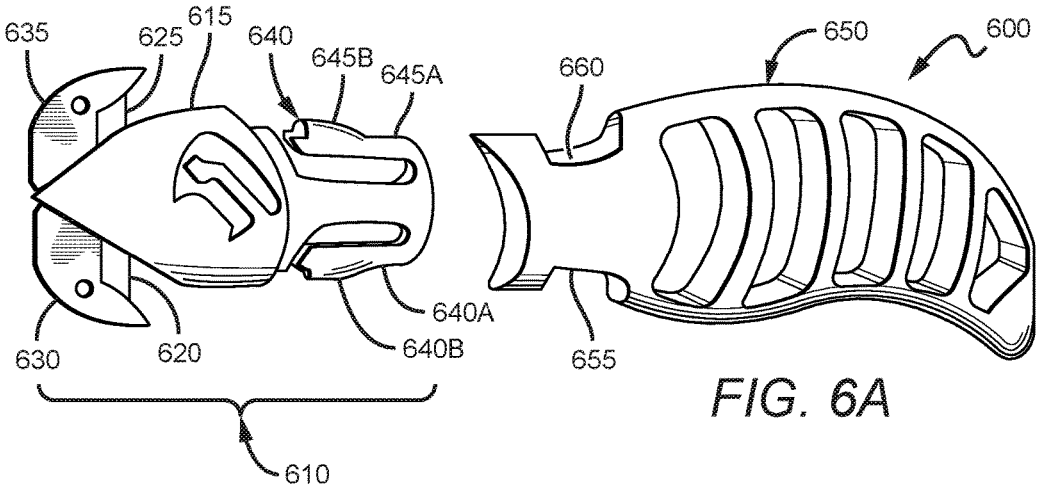
FIG. 6A illustrates yet another embodiment of a utility knife, including a blade cartridge and tool handle.
Figure 6B:
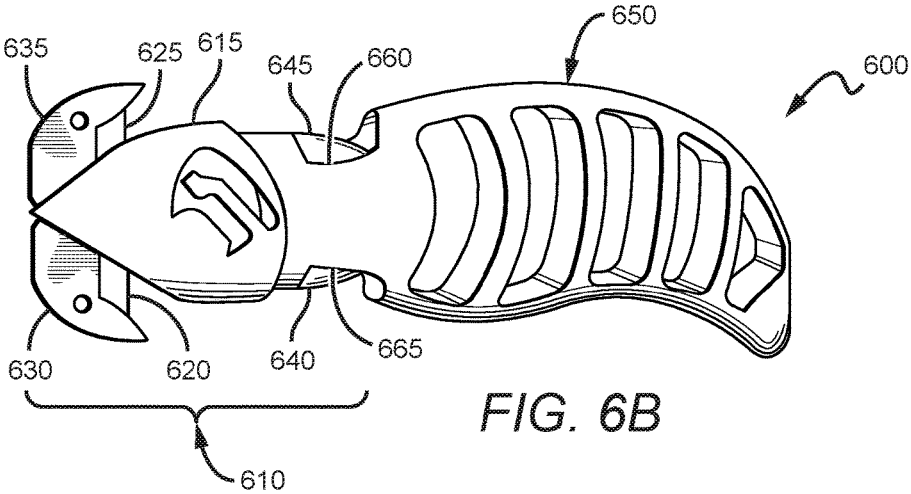
FIG. 6B illustrates the utility knife of FIG. 6A, wherein the cartridge is locked into the tool handle.

FIGS. 6A-6B illustrate yet another utility knife 600, which can be used with or without a blade cover. Utility knife 600 is similar to knife 500, and includes a cartridge 610 and tool handle 650. Cartridge 610 comprises a blade holder 615 and a stem 640 including two flexible arms 645A, 640A having locking members 645B and 640B. Handle 650 comprises two catches 660 and 655 that are sized and dimensioned to receive locking members 645B and 640B, respectively. Cartridge 610, however, includes two blade top shields 635 and 630, each of which are coupled to blade holder 615 and at least partially define a recess.

An edge of blade holder 615 and an edge of blade top shield 635 define a recessed area that includes blade 625. Only a small portion of blade 625's edge is exposed (e.g., less than 2 cm, less than 1.5 cm, less than 1 cm), and the exposed edge portion is recessed relative to an end of blade top shield 635, which could comprise a piercer or a blunt tip.

Viewed from another perspective, cartridge 610 is configured such that an object will not be cut by blade 625 unless placed within a recess defined by an edge of a blade holder and an edge of a blade top shield. A different edge of blade holder 615 and an edge of blade top shield 630 define a recessed area that includes blade 620. Only a small portion of blade 620's edge is exposed, and the exposed edge portion is recessed relative to an end of blade top shield 630, which could comprise a piercer or a blunt tip.

Similarly to utility knife 500, each blade top shield 635 or 630's end or tip could extend at least 1 mm, at least 2 mm, at least 5 mm, or even at least 10 mm or more further towards the cartridge stem than blade 625 or 620's edge.

In some aspects of the inventive subject matter, a cartridge can include a movable member, a blade holder, and a blade. A blade cover coupled to the cartridge can include an opening member, and be configured to move from a closed configuration to an open configuration via an interaction of the opening member and the movable member. Additionally or alternatively, the blade could compose a hook-type cutter, and include an exposed edge portion that is recessed relative to at least one of the blade holder and a blade tip cover. FIGS. 7A-7D illustrate a utility knife 700 having such features.

Figure 7A:
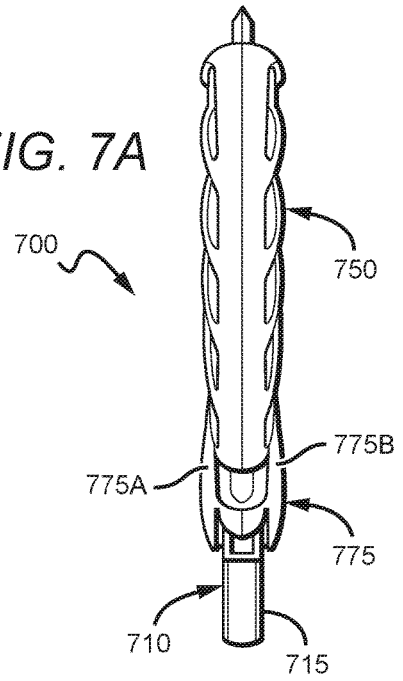
FIGS. 7A-7D illustrate a utility knife of the inventive subject matter having a hook type cutter.
Figure 7B:
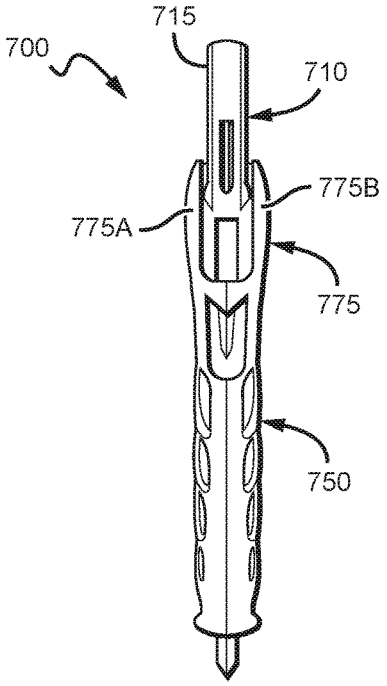

FIG. 7A is a top view of knife 700, which includes handle 750, cartridge 710 removably coupled to handle 750, anti-tamper guard 775 having first and second sides (775A, 775B), and blade cover 715. As can more clearly be seen in the bottom view of FIG. 7B and the side views of FIGS. 7C and 7D, the first and second sides 775A, 775B of anti-tamper guard 775 form a gap that is sized and dimensioned to receive at least portions of cartridge 710 and blade cover 715.

Anti-tamper guard 775 protects blade cover 715 from being tampered with or taken off of cartridge 710 when cartridge 710 is coupled with tool handle 750. First and second sides 775A, 775B are substantially parallel to one another, and positioned, sized and dimensioned to receive a thickness of blade cover 715.

It should be appreciated that the cartridge and blade cover of knife 700 could function similarly to the cartridge and blade cover shown in FIG. 1A. For example, cartridge 710 could include a blade holder, a blade, a stem having two flexible arms, and a lock protrusion (e.g., 50 of FIG. 1A). Blade cover 715 could include a lock opening (e.g., 55 of FIG. 1A), and be configured to move (e.g., slide) relative to the blade holder from a locked position, as shown in FIG. 1A, to an unlocked position, as shown in FIG. 1B. In this manner, blade cover 715 can be locked in a safe position that keeps the blade from being inadvertently exposed, regardless of whether or not the cartridge has been inserted into a tool handle.

Additionally or alternatively, blade cover 715 could be configured to move (e.g., rotate) relative to the blade holder and blade from a blade covering configuration, as shown in FIG. 1B, to a blade exposing configuration, as shown in FIG. 1C. For example, the blade holder could comprise a movement protrusion (e.g., 70 of FIG. 1A) that is configured to cooperate with blade cover's angled channel (e.g., 105 of FIG. 1A) to allow for rotation of blade cover 715 when it is in an unlocked position.

In some other embodiments, blade cover 715 could be configured to move from a blade covering configuration to a blade exposing configuration, but not be configured to move between a locked position and an unlocked position.

Additionally, the blade cover could be biased to a blade covering configuration (e.g., via a spring).

In some other embodiments, blade cover could be configured to move between only two positions—away and towards a cartridge stem via a lock opening of the blade cover and a lock protrusion of the cartridge, or vice versa. When blade cover is positioned towards the cartridge stem, the blade edge could be entirely covered by the blade cover. When blade cover is positioned away from the cartridge stem, the blade edge could be exposed. The blade cover could be biased towards a blade covering position, wherein the lock protrusion could be positioned within one wide end of the nephroid lock opening, similar to what is shown in FIG. 1B. When a force is applied, the blade cover could move towards a blade exposing position, wherein the lock protrusion could be positioned within the other wide end of lock opening, similar to what is shown in FIG. 1A.

Figure 7C:
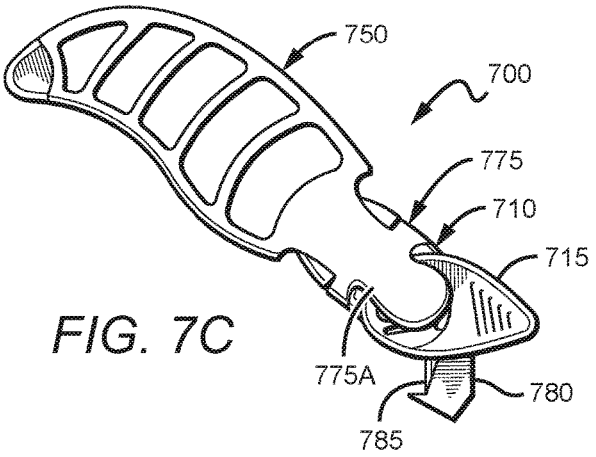
Figure 7D:
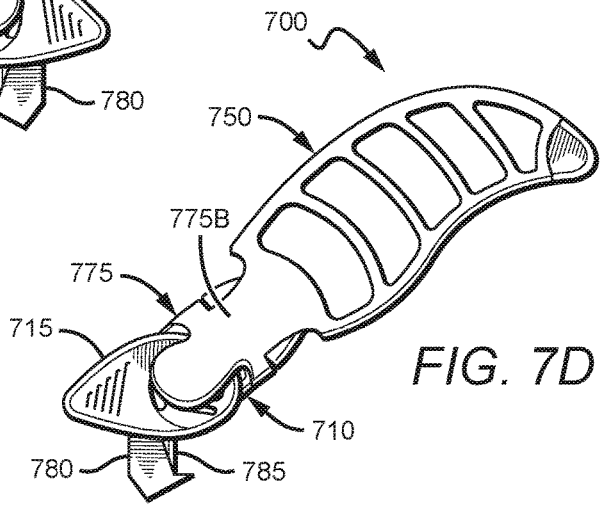

The outer surface of one or both of the first and second sides 775A, 775B could include a logo, design or other marking (as shown in FIGS. 7C and 7D). An inner surface of one or both sides could include a protrusion that is sized and dimensioned to couple with an aperture or recess of a lock protrusion (e.g., 50 in FIG. 1A). For example, each of the two portions could include a protrusion, and the two protrusions could face one another. These two protrusions could couple with a through-hole or recessed portions of a lock protrusion via a snap fit or any other suitable mechanism.

Figure 9:
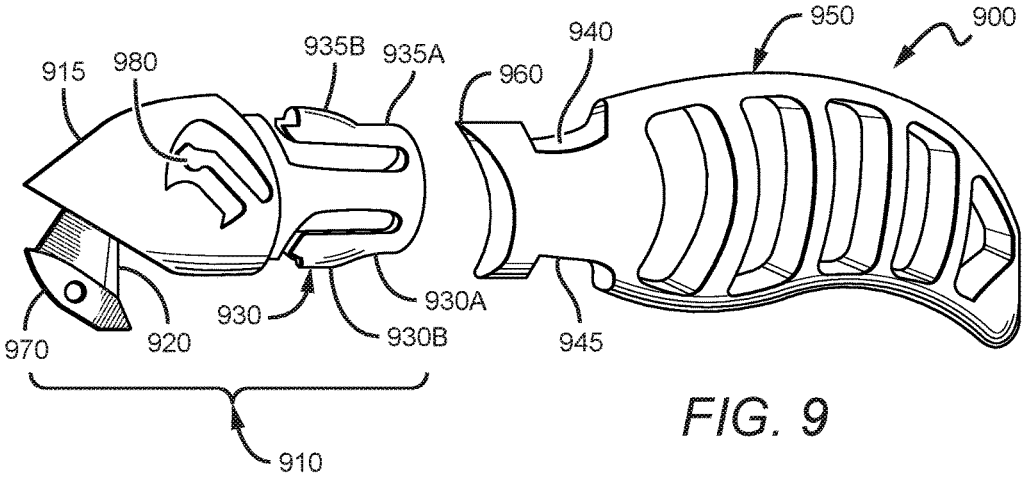
FIG. 9 illustrates another utility knife having a blade tip cap.
Figure 10:
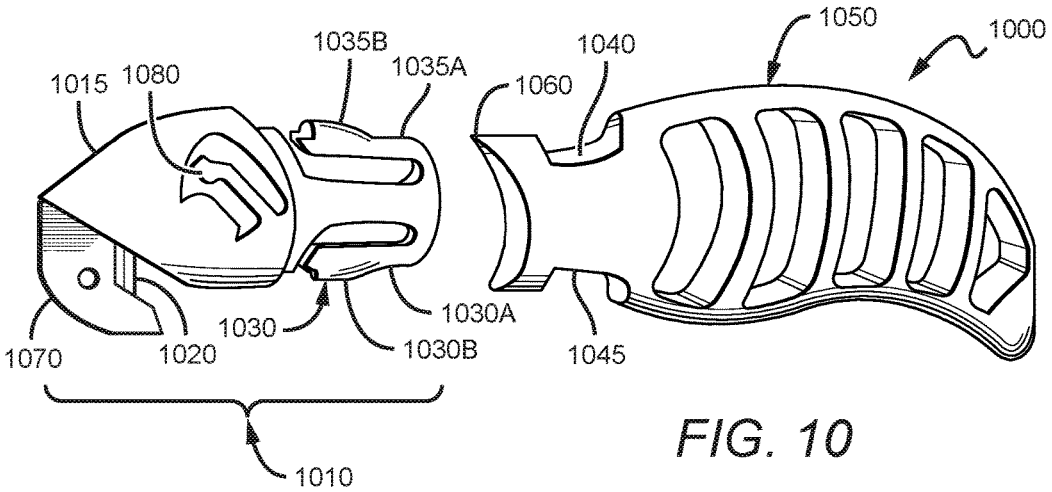
FIG. 10 illustrates yet another utility knife having a blade tip cap.

Knife 700 could also include a blade tip cover 780, which can be sized and dimensioned to receive at least a portion of blade 785. Blade tip cover 780 could be fixedly attached to blade 785, movably but permanently attached to blade 785 or other portion of cartridge 710, or removably coupled to blade 785 via a suitable mechanism. Some exemplary knives having different blade tip covers are illustrated in FIGS. 8-10, but it should be appreciated that any suitable cover that is sized and dimensioned to securely receive a portion of a blade that not secured within a cartridge blade holder is contemplated.

Figure 8:
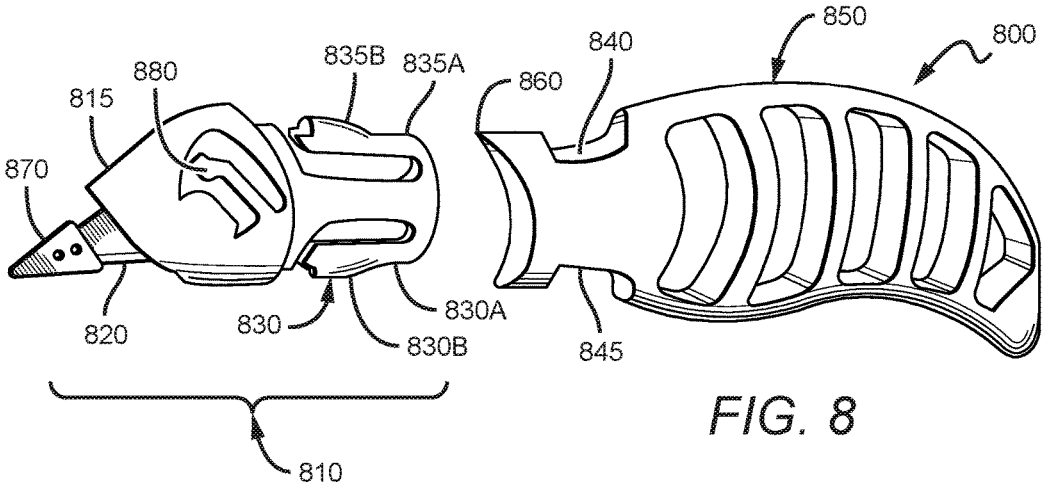
FIG. 8 illustrates a utility knife having a blade tip cap.

FIG. 8 illustrates utility knife 800, which includes a handle 850 and cartridge 810. Cartridge 810 includes a blade holder 815, which secures blade 820 in place, and blade tip cap 870, which advantageously provides protection against inadvertent cuts by creating a hook-type cutter with blade 820 and blade holder 815. Cartridge 810 also includes a moving member or biasing member 880 positioned within a recess or through-hole of cartridge, which is configured to flex when a pressure is applied, for example, by a blade cover's opening member. Stem 830 of cartridge 810 includes two flexible arms 830A, 835A, each of which include a locking member 830B, 835B, respectively.

Stem 830 is sized and dimensioned to be received by an opening 860 of handle 850. Arms 835A and 830A can be squeezed towards one another to allow locking members 835B, 830B to pass through opening 860, and snap or otherwise be released into first and second catches 840, 845, respectively.

The portion of blade 820 that is not secured within blade holder 815 is triangular in shape and includes a pointy end. Blade tip cap 870 is similarly triangular in shape, and is sized and dimensioned to receive the pointy end of blade 820, leaving an exposed blade portion between blade holder 815 and blade tip cap 870. Viewed from another perspective, the exposed portion of blade 820's edge is recessed relative to blade holder 815 and blade tip cap 870, and forms a hook-type cutter.

FIG. 9 illustrates another utility knife 900 including a hook type cutter. Cartridge 910 includes a blade holder 915, which secures blade 920 in place, and blade tip cap 970. Cartridge 910 also includes a biasing member 980 positioned within a recess or through-hole of cartridge, which is configured to flex when a pressure is applied, for example, by a blade cover's opening member. Stem 930 of cartridge 910 includes two flexible arms 930A, 935A, each of which include a locking member 930B, 935B, respectively.

Stem 930 is sized and dimensioned to be received by an opening 960 of handle 950. Arms 935A and 930A can be squeezed towards one another to allow locking members 935B, 930B to pass through opening 960, and snap into first and second catches 940, 945, respectively.

The portion of blade 920 that is not secured within blade holder 915 is trapezoidal or trapezium in shape, and includes two pointy ends. A first pointy end is sharp and includes the blade's cutting edge. A second pointy end has a greater thickness, and is not typically used to create a cut. Blade tip cap 970 can comprise any suitable shape, and is sized and dimensioned to receive the first and second pointy ends of blade 920, leaving an exposed blade portion between blade holder 915 and blade tip cap 970.

FIG. 10 illustrates yet another utility knife 1000 including a hook type cutter. Cartridge 1010 includes a blade holder 1015, which secures blade 1020 in place, and blade tip cap 1070. Blade holder 1050 and blade tip cap 1070 cooperate to cover the entirety of blade 1020, exclusive of a portion of a cutting edge.

Cartridge 1010 also includes a biasing member 1080 positioned within a recess or through-hole of cartridge, which is configured to flex when a pressure is applied, for example, by a blade cover's opening member. It should be appreciated that biasing member 1080 is optional, and may not be included in embodiments not including a rotating blade cover. Stem 1030 of cartridge 1010 includes two flexible arms 1030A, 1035A, each of which include a locking member 1030B, 1035B, respectively.

Stem 1030 is sized and dimensioned to be received by an opening 1060 of blade holder 1050. Arms 1035A and 1030A can be squeezed towards one another to allow locking members 1035B, 1030B to pass through opening 1060, and release into first and second catches 1040, 1045, respectively.

Blade 1020 is a quadrilateral, but could alternatively comprise any other suitable shape. Blade 1020 includes an outer perimeter, at least part of which comprises a cutting edge. Blade tip cap 1070 extends from blade holder 1015 and around the outer perimeter of blade 1020 that is not covered by blade holder 1015, leaving only a small portion of blade 1020's cutting edge accessible. The accessible portion of blade 1020's cutting edge could have any suitable length, including for example, between 1-20 mm, between 1-15 mm, between 1-10 mm, between 5-15 mm, or between 5-10 mm, 10-15 mm. Viewed from another perspective, it is contemplated that blade holder 1015 and blade tip cap 1070 could enclose at least 50%, at least 70%, at least 80%, or even 90% or more of blade 1020's outer perimeter.

In some preferred embodiments, the blade is positioned relative to the blade holder 1015 and blade tip cap 1070 such that the exposed blade edge portion is recessed, thereby forming a hook type cutter. Viewed from another perspective, the blade tip cap and an edge of blade holder 1050 each extend further towards the cartridge stem 1030 than blade 1020's cutting edge. Viewed from yet another perspective, the blade holder and blade tip cap form a notch or recess in which blade 1020 (including its cutting edge) is disposed.

It should be appreciated that the knives of FIGS. 8, 9 and 10 could each include an anti-tamper guard, or any other feature described throughout the application.

FIGS. 11A-11C illustrate a utility knife of the inventive subject matter similar to the knives of FIGS. 8-10, and including a blade cover 1005 that is configured to rotate relative to cartridge 1110. FIG. 11A illustrates blade cover 1105 in a closed position, with cartridge 1110 removed from handle 1150. FIG. 11B illustrates blade cover in a closed position, with cartridge 1110 coupled with handle 1150. FIG. 11C illustrates blade cover in an open position, with cartridge 1110 coupled with handle 1150.

Utility knife 1100 includes cartridge 1110 and tool handle 1150. Cartridge 1110 includes a blade holder, which secures blade 1120 in place, and blade tip cap 1170. Cartridge 1110 also includes a biasing member 1180 positioned within a recess or through-hole of cartridge 1110. Biasing member 1180 is configured to flex when a pressure is applied by blade cover's opening member 1105A, as further described below. In some preferred embodiments, the cartridge is sized and dimensioned such that the biasing member can move at least 25 mm in at least one direction, at least 20 mm in at least one direction, at least 15 mm in at least one direction, at least 10 mm in at least one direction, or at least 5 mm in at least one direction.

Stem 1130 of cartridge 1110 includes two flexible arms 1130A, 1135A, each of which include a locking member 1130B, 1305B, respectively. Stem 1130 is sized and dimensioned to be received by an opening 1160 of handle 1150. Arms 1135A and 1130A can be squeezed towards one another to allow locking members 1135B, 1130B to pass through opening 1160, and snap into first and second catches 1140, 1145, respectively.

Opening member 1105A comprises a stem that leads to a nub or protuberance. Biasing member 1180 similarly includes a stem that leads to a nub or protuberance, and the nubs of the two members face one another. When blade cover 1105 is in a closed position, biasing member 1180's nub is positioned beneath opening member 1105's nub. As a force is applied to blade cover 1105 in order to expose blade 1120, biasing member 1180's nub moves up towards opening member 1105A's nub, aligns with opening member 1105's nub, and then sits above opening member 1105's nub.

It should be appreciated that opening member 1105A could be less flexible than biasing member 1180 such that opening member 1105A does not change shape when blade cover 1105 is moved. Additionally or alternatively, opening member 1105A could be positioned on blade cover 1105 such that opening member 1105A does not or cannot move, even when a pressure is applied. For example, opening member 1105A could be fixedly attached to, or comprise an extension of, an inner surface of blade cover 1105.

Methods of making cartridges as described are also contemplated. A cartridge as detailed in FIGS. 1A-11C can be assembled by fixing a blade to a cartridge. The blade can be made of metal, plastic, ceramic, wood, bone, keratin, enamel, carbon, stone, obsidian, glass, diamond, or any other material suitable for cutting or applying directed pressure. Further, the blade may be straight, curved, round, angled, serrated, sharpened, dulled, or otherwise configured as appropriate for the desired use. The cartridge may be a single piece or the composite of several pieces. The pieces could be of the same material (e.g., injection molded plastic) or of a range of materials.

A cartridge as described above can be made by fixing a blade cover to the blade holder. The blade cover can be an integral part of the blade holder and can be made of the same material as the blade holder. For example, the blade cover and blade holder can be made of a single piece of flexible rubber or rigid plastic. Further, the blade cover and blade holder can be made primarily of the same material as an integral piece, while the blade holder is further comprised of other components or materials. The blade cover and the blade holder can also be separate components, and can be made of different materials or the same material. The blade cover can be fixed to the blade holder by means that permit the blade cover to rotate (partially or fully), pivot, slide, swivel, turn, bend, flex or otherwise move in relation to the blade.

A cartridge as described above can also be made such that the blade cover and the blade holder are attached at a junction. The junction can be further configured such that a part of the junction prevents or allows the blade cover to move in relation to the blade, while another part of the junction provides the avenue or means for the blade cover to move in relation to the blade. The means of preventing or allowing movement, and restricting the direction of movement, of the blade cover in relation to the blade can be an integral part of the junction between the blade cover and the cartridge, or can be a separate component. Further, the components can be made of the same or different materials.

A cartridge as described above can further be made by fixing flexible arms to the blade holder. The flexible arms can be a separate component from the blade holder or can be an integral aspect of the blade holder. The flexible arms and blade holder can be made of the same material or of different materials. The flexible arms can be configured such that they depress while being inserted into a tool handle, and then return to an undepressed position once completely inserted into the tool handle.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A cartridge for coupling with a blade cover and a handle, the cartridge, comprising:

a blade having an exposed cutting edge;

the blade mounted in a blade holder such that when the exposed cutting edge is oriented vertically, the exposed cutting edge is divided by the blade holder into an upper cutting edge and a lower cutting edge; and a biasing member configured to move the blade cover to cover the lower cutting edge.

2. The cartridge of claim 1, further comprising a shield that has a lower blunt tip that covers an end of the lower cutting edge, and an upper blunt tip that covers an end of the upper cutting edge.

3. The cartridge of claim 1, wherein the biasing member is a flexible arm.

4. The cartridge of claim 1, further comprising a stem having a flexible arm and a locking member extending from the flexible arm.

* * * * *